US006557317B2

(12) United States Patent
Sorkin

(10) Patent No.: US 6,557,317 B2
(45) Date of Patent: May 6, 2003

(54) CONCRETE REINFORCING BAR SUPPORT

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 0 days.

(21) Appl. No.: 09/894,269

(22) Filed: Jun. 29, 2001

(65) Prior Publication Data

US 2003/0000170 A1 Jan. 2, 2003

(51) Int. Cl.[7] ..... E04C 5/16
(52) U.S. Cl. ..... 52/684; 52/682; 52/689; 404/135
(58) Field of Search ..... 52/677, 682, 684, 52/685, 686, 689; 404/134, 135, 136

(56) References Cited

U.S. PATENT DOCUMENTS

| | | | | | |
|---|---|---|---|---|---|
| D214,418 | S | * | 6/1969 | Laurini | D8/356 |
| 3,449,882 | A | * | 6/1969 | Ott et al. | 52/689 |
| 3,471,987 | A | * | 10/1969 | Yelsma | 52/684 |
| 3,673,753 | A | | 7/1972 | Anderson | |
| 3,788,025 | A | | 1/1974 | Holmes | |
| 4,063,397 | A | * | 12/1977 | Follows | 52/684 |
| 4,598,523 | A | * | 7/1986 | Tolliver | 52/685 |
| 4,617,775 | A | * | 10/1986 | Padrun | 52/684 |
| 4,835,933 | A | | 6/1989 | Yung | |
| 5,791,095 | A | | 8/1998 | Sorkin | |
| 5,893,252 | A | | 4/1999 | Hardy, Jr. et al. | |
| 6,276,108 | B1 | * | 8/2001 | Padrun | 52/684 |

FOREIGN PATENT DOCUMENTS

| | | | | |
|---|---|---|---|---|
| GB | 986450 | * | 3/1965 | 52/677 |
| GB | 2077319 A | * | 12/1981 | 52/677 |
| GB | 2139664 A | * | 11/1984 | 52/686 |
| GB | 2169931 A | * | 7/1986 | E04C/5/18 |

* cited by examiner

*Primary Examiner*—Carl D. Friedman
*Assistant Examiner*—Brian E. Glessner
(74) *Attorney, Agent, or Firm*—Harrison & Egbert

(57) ABSTRACT

A concrete reinforcing bar support including a base, a support structure extending upwardly from the base, a first clamping member affixed to the support structure and extending upwardly above a top surface of the support structure, a second clamping member affixed to the support structure and extending upwardly above a top surface of the support structure, and a third clamping member affixed to the support structure and extending upwardly above the top surface of the support structure. The second clamping member has an interior surface generally facing the interior surfaces of the first and third clamping members. The first clamping member is separated by a space from the third clamping member. Ribs extend inwardly from the interior surfaces of each of the clamping members so as to compressively contact a reinforcing bar placed interior of the clamping members. The support structure has a generally H-shaped cross-section in a plane parallel to said base.

17 Claims, 5 Drawing Sheets

CONCRETE REINFORCING BAR SUPPORT

BACKGROUND OF THE INVENTION

1. Field of the Invention

The present invention relates to devices for use in connection with construction. More particularly, the present invention relates to reinforcing bar chair apparatus for use in reinforced concrete construction.

2. Description of Related Art

In reinforced concrete construction applications, such as highways, floors, or walls of buildings, spacer devices, commonly referred to as chairs, are required for supporting and maintaining reinforcing rods or bars which are positioned in the area where concrete is to be poured. These reinforcing rods are sometimes referred to as "rebars". Depending on such parameters, such as the total surface area and the thickness of the end product of concrete, reinforcement is mandated in varying degrees by building codes. One such method of reinforcement involves a steel mesh, while in major concrete construction, such as highways and high-rise buildings, reinforcing rods of various diameters, typically one-half inch or more, are required. In addition, on such jobs, the reinforcing bars may be positioned in spaced layers due to the thickness of the floor. In some installations, a first layer of rebar is provided, with the reinforcing rods or rebars in spaced parallel relationship, and generally parallel to the surface on which the concrete is to be poured. A second layer of rebar is then added, with the orientation of the second layer perpendicular to the first layer, thus forming a grid or lattice work. After the reinforcing bars or lattice work is prepared, the concrete is then poured over this grid or framework, which is ultimately embedded within the highway floor or wall.

For a concrete floor on a prepared surface, spacers or chairs are utilized for providing the vertical separation of the rebar grid from the surface on which the concrete is to be poured. The prepared surface may be a wood, plywood, or foam structure or a compacted surface, the latter of which my be provided with a layer of compacted sand, with a plastic sheet covering thereon providing a moisture barrier. Spacers or chairs are then positioned on the prepared surface for supporting the rebars in a plane generally parallel to the prepared surface. Typically, with modem building codes, a spacer is needed for every linear foot of the rebar.

With rebar spacers or chairs, one common problem is occasioned by the number of different sizes required to be maintained by a supplier to accommodate different thicknesses of poured concrete, such as two-inch, three-inch, four-inch, etc. and many intermediate fractional sizes. Another common problem with rebar spacers has been encountered in the method of securing the rebar to the chair or spacer, with twisted wire being the most common method. This particular problem is more acute when mutually perpendicular layers of rebar are coupled to the same chairs or spacers. With wire connections, a first strip of wire secures the first layer and a second strip of wire secures the perpendicular layer of rebar. With any metal or wire within the reinforcing bar grid work, there is a problem with rusting or decomposing of the wire or metal components.

In the past, various patents have issued relating to these chair supports for reinforcing rods. In particular, the present inventor is the owner of U.S. Pat. Nos. 5,555,693 and 5,791,095 for such chairs. Each of these chairs has a receiving area with a horizontal section and a generally parabolic section extending transverse to the horizontal section. A plurality of separate legs extends downwardly from the receiving area. Each of the legs has a foot extending horizontally outwardly therefrom. The receiving area and the plurality of legs are integrally formed together of a polymeric material.

U.S. Pat. No. 3,788,025, issued on Jan. 29, 1974 to S. D. Holmes, describes a chair for supporting in right angular relation two reinforcing rods used in construction. The chair has a lower arched base part and an upper rod supporting part integral with the base. The base is an arched support with means for providing lateral, longitudinal, vertical support and strength. The rod supporting part comprises two spaced apart arms, the lower parts of which form a saddle for receiving one reinforcing rod and the upper part for each of which is formed by two separate spaced upstanding inwardly concave arms, the upper ends of which are spaced to provide an opening through which a second reinforcing rod, arranged at a right angle to the first rod, may be introduced.

U.S. Pat. No. 3,673,753, issued on Jul. 4, 1972 to G. C. Anderson, teaches a concrete reinforcing bar support in which a base supports an upright pedestal. A lower clamping portion is supported by the pedestal which has a first rod-receiving open passageway therethrough. Resilient detents extend from the lower clamping portion to retain a reinforcing rod disposed through the first passageway. An upper clamping portion is provided which includes a pair of hook members extending from the lower clamping portion. Each of the hook members has a mouth opening in the same direction to define a second rod-receiving passageway which is normally disposed to the first passageway.

U.S. Pat. No. 4,835,933 issued on Jun. 6, 1989 to F. P Yung, describes a spacer assembly which includes a spacer with a body having a base portion with a generally centrally disposed support post portion. One end of the support post portion is formed as a planar surface with a centrally located generally concave saddle portion configured for receiving a reinforcing bar. The planar surface is provided with apertures therethrough on both sides of the saddle. A clamp member is provided for simultaneously securing mutually perpendicular rebars to the chair. The clamp member is a generally U-shaped lower portion, with the depending arms thereof in spaced generally parallel relationship for engaging a first bar within the saddle. A generally identical pair of hook arms extends upwardly from the bight portion. The hook arms are oriented for engaging a second rebar in an orientation perpendicular to the first rebar engaged within the saddle portion.

U.S. Pat. No. 5,893,892, issued on Apr. 13, 1999 to Hardy, Jr. et al, teaches an apparatus for fixating and elevating an interconnected rebar lattice having individual longitudinal and transverse rebar intersections. The apparatus includes a holding portion having an open-ended recess with two opposing walls being generally U-shaped. The recess has longitudinal access and is sized and shaped to receive a longitudinal rod. An arc-shaped portion extends laterally outwardly from each opposing wall and perpendicular to the longitudinal access of the recess. The arc-shaped portion includes a recess and an opposing wall with each wall including a snap-type lock. A locking member has a generally arc-type portion and includes a snap-type lock for attaching to the arc-type portion and engaging with the snap-type lock of the arc-type portion. A leg portion extends downwardly from the holding portion and is integrally attached to a base.

FIG. 1 shows one type of prior art concrete reinforcing bar support that is commonly used. Bar support 1 includes a base 2, a support structure 3 extending upwardly from the base 2, a first clamping member 4 affixed to the support structure 3 and extending upwardly thereabove, a second clamping member 5 affixed to the support structure and extending upwardly above the top surface of the support structure 3, and a third clamping member 6 affixed to the support structure and extending upwardly above the top surface of the support structure 3. As can be seen, the support structure 3 has a generally T-shaped cross-section of the support structure 3. Particularly, the support structure 3 includes a panel 3*a* extending vertically upwardly from the base 2, a first angled gusset 3*b* extending upwardly on one side of the panel 3*a* and connected, at a top end thereof, to the second clamping member 5. Gusset 3*b* is connected centrally to the panel 3*a*. A pair of gussets 3*c* and 3*d* are formed on the opposite side of the panel 3*a* and extend upwardly so as to connect, at their upper ends, to clamping members 4 and 6, respectively. The first clamping member 4 includes a detent 4*a*. The second clamping member 5 includes a detent 5*a*. The third clamping member 6 includes a detent 6*a*. The second clamping member 5 has an interior surface generally facing the interior surfaces of the first and third clamping members. The interior surfaces of the first, second and third clamping members are suitable for receiving a reinforcing bar therebetween. The base 2, the support structure 3, the first clamping member 4, the second clamping member 5 and the third clamping member 6 are integrally formed together of a polymeric material.

Unfortunately, with this device, each of the clamping members 4, 5 and 6 has a configuration which is suitable for receiving only a single diameter of rebar therein. There is no technique whereby the clamping members 4, 5 and 6 can automatically adjust to the various sizes of rebar. Also, when there is a deflection of the rebar, the rebar can easily push through from the clamping members 4, 5 and 6 and past the detents 4*a*, 5*a* and 6*a*. This prior art bar support 1 has no way of suitably locking the rebar in the area between the clamping members 4, 5 and 6 and for preventing the release of the rebar from therebetween.

Additionally, the prior art bar support 1 also has a generally unstable support structure. Since the support structure is of a generally T-shaped cross-section, the support structure can deflect under the load of a rebar. Additionally, the T-shaped cross-section of the support structure can tip over when certain forces are applied to the top surface of the support structure.

It is an object of the present invention to provide a bar support which is corrosion-proof.

It is another object of the present invention to provide a bar support that is adaptable to receive various diameters of rebar therein.

It is another object of the present invention to provide a bar support that can be placed on various flat surfaces.

It is another object of the present invention to provide a bar support that can be easily snap-fitted onto and locked around a reinforcing bar.

It is another object of the present invention to provide a bar support which allows a free flow of concrete therethrough.

It is a further object of the present invention to provide a bar support with a load-resistant stable support structure.

It is a further object of the present invention to provide a reinforcing bar support which is easy to use, easy to manufacture and relatively inexpensive.

These and other objects and advantages of the present invention will become apparent from a reading of the attached specification and appended claims.

BRIEF SUMMARY OF THE INVENTION

The present invention is a concrete reinforcing bar support comprising a base, a support structure extending upwardly from the base, a first clamping member affixed to the support structure and extending upwardly above the top surface, and a second clamping member affixed to the support structure and extending upwardly above the top surface. Each of the first and second clamping members has an interior surface suitable for receiving a reinforcing bar there-between. The interior surface of the first clamping member faces the interior surface of the second clamping member. The base, the support structure and the first and second clamping members are integrally formed together of a polymeric material. A third clamping member is affixed to the support structure and extends upwardly above the top surface. The third clamping member has an interior surface generally facing the interior surface of the second clamping member. The third clamping member is separated by a space from the first clamping member. The second clamping member is positioned in a plane of the space between the first and third clamping members.

Each of the clamping members has a detent formed therein. The detent has an angled surface extending upwardly and outwardly therefrom.

Each of the clamping members has a plurality of ribs extending inwardly from the interior surface thereof. Each of the ribs is parallel to and spaced from an adjacent rib. The lower rib of the plurality of ribs extends inwardly from the interior surface a greater distance than that of an upper rib of the plurality of ribs. Each of the plurality of ribs is flexible. Each of the plurality of ribs extends in a horizontal plane. When the reinforcing bar is placed between the clamping members, the plurality of ribs will flex in such a manner so as to secure the rebar in a desired position between the clamping members regardless of the diameter of the rebar. The plurality of ribs lock the rebar in the area between the clamping members.

The first clamping member, the second clamping member and the third clamping member have identical configurations. The second clamping member faces in an opposite direction to that of the first and third clamping members. Each of the clamping members are resilient members. The innermost edge of the interior surface of the first clamping member is spaced from an innermost edge of the interior surface of the second clamping member by less than a diameter of the reinforcing bar.

In the present invention, the base is a flat generally rectangular surface. The support structure comprises a first truncated pyramidal wall extending upwardly and inwardly from one side of the base, a second truncated pyramidal wall extending upwardly and inwardly from another side of the base, and a panel extending vertically upwardly from the base between the first and second truncated pyramidal walls. The panel has a plurality of apertures formed therein so as to allow a free flow of concrete therethrough. The support structure is particularly configured to withstand heavy loads and to resist tipping over.

BRIEF DESCRIPTION OF SEVERAL VIEW OF THE DRAWINGS

DETAILED DESCRIPTION OF THE INVENTION

Figure 2:
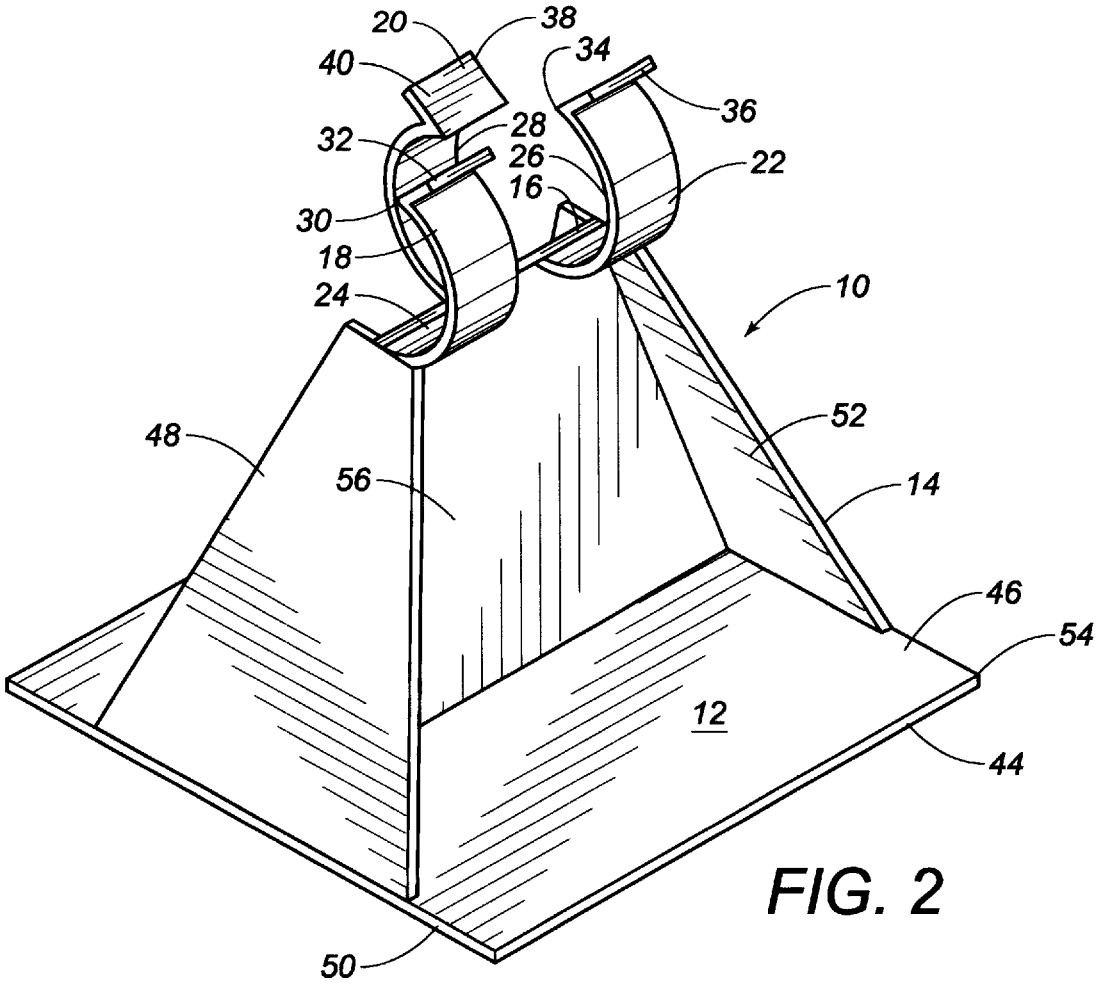
FIG. 2 is an upper perspective view of a simplified view form the bar support of the present invention.

Referring to FIG. 2, there is shown at 10 the simplified form of the bar support in accordance with the teachings of the present invention. The simplified form of the bar support 10 shows a superior support structure which withstands heavy loads and which is resistive of tipping. Bar support 10 includes a base 12, a support structure 14 extending upwardly from the base 12 so as to define a top surface 16 opposite to the base 12, a first clamping member 18, a second clamping member 20 and a third clamping member 22. In the present invention, each of the first clamping member 18, the second clamping member 20 and the third clamping member 22 are affixed to the support structure 14 and extend upwardly above the top surface 16. The first clamping member 18 and the third clamping member 22 have respective interior surfaces 24 and 26 which generally face the interior surface 28 of the second clamping member 20. Each of the clamping members 18, 20 and 22 have identical configurations. The second clamping member 20 faces in a different direction than the clamping members 18 and 22. The first clamping member 18 is spaced by a distance from the third clamping member 22 on one side of the top surface 16. The second clamping member 20 is positioned within a plane of the space between the first clamping member 18 and the second clamping member 22 on an opposite side of the top surface 16.

In the present invention, the base 12, the support structure 14, the first clamping member 18, a second clamping member 20 and the third clamping member 22 are integrally formed together of a polymeric material.

The first clamping member 18 has a generally curved interior surface 24 of a size suitable for receiving a side of a reinforcing bar therein. Similarly, the third clamping member 22 has its interior surface 26 of a suitable curvature for receiving the same side of the reinforcing bar therein. The second clamping member 20 also has a curved interior surface 28 for compressively engaging an opposite side of a rebar. The reinforcing bar is positioned above the top surface 16 and within the interior areas of the clamping members 18, 20 and 22.

In FIG. 2, it can be seen that the first clamping member 18 has a detent 30 formed adjacent an upper end thereof. Detent 30 has an angled surface 32 extending upwardly and outwardly therefrom. Similarly, the third clamping member 22 has a detent 34 formed adjacent an upper end thereof. Another angled surface 36 extends from detent 34 upwardly and outwardly therefrom. The second clamping member 20 also has a detent 38 formed thereon with an upwardly and outwardly angled surface 40 extending from the detent 38. The upwardly and outwardly angled surfaces 32, 36 and 40 serve to "funnel" the rebar into the interior areas of the respective clamping members 18, 20 and 22 so that the rebar will reside in a proper position along the top surface 16. The detents 30 and 34 are spaced from the detent 38 by less than the diameter of the rebar. As such, after the rebar is placed into the interior areas, this close spacing will prevent the rebar from easily sliding outwardly therefrom.

Figure 1:
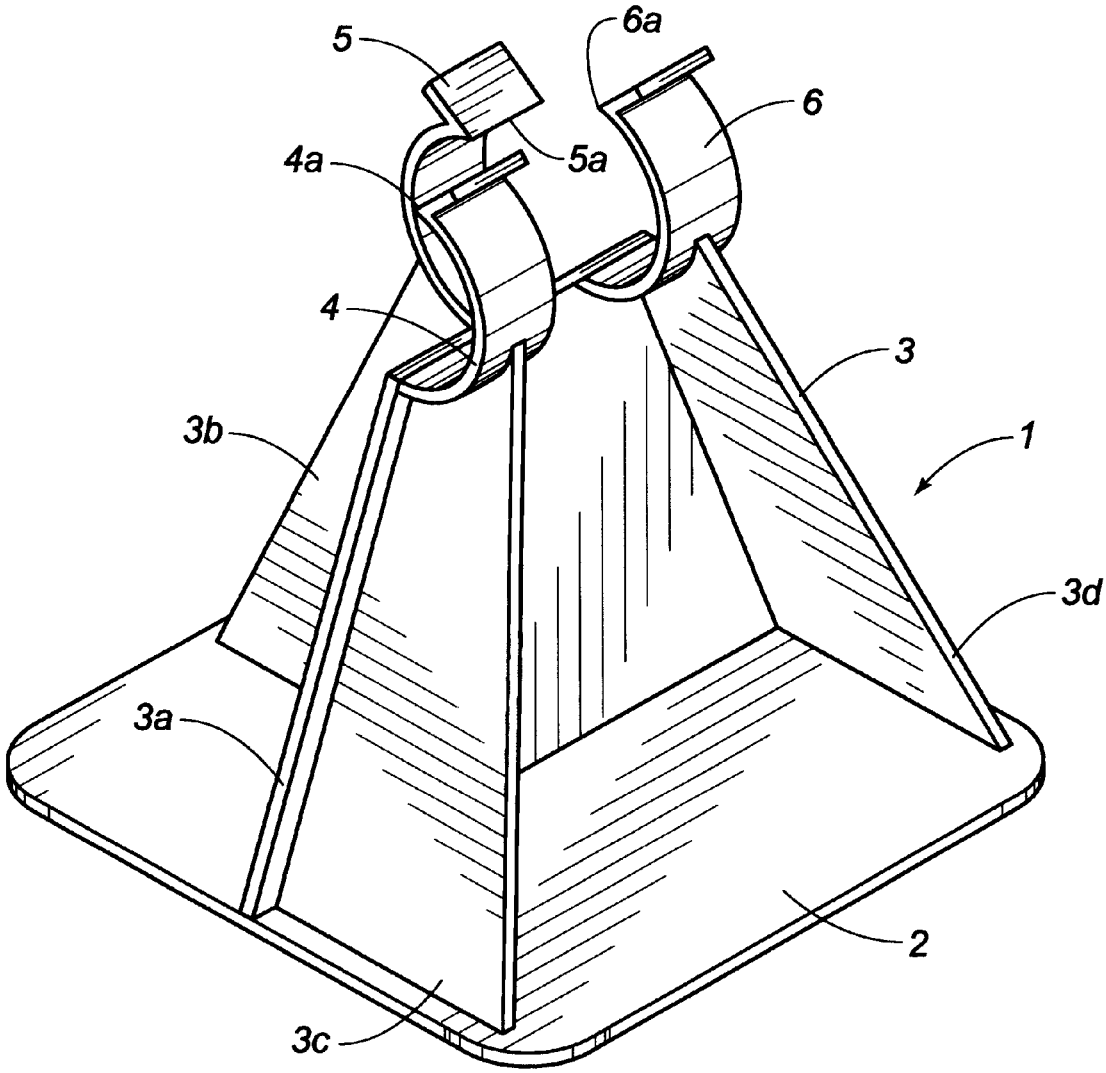
FIG. 1 Prior Art
FIG. 1 is a perspective view of a prior art bar support.

In the present invention, the base 12 is of a generally square or rectangular configuration. The base 12 has a flat bottom surface 44 and a generally flat top surface 46. The support structure 14 includes a first truncated pyramidal wall 48 extending upwardly and inwardly from side 50 of the base 12. The support structure 14 also includes a second truncated pyramidal wall 52 extending upwardly and inwardly from an opposite side 54 of the base 12. A panel 56 extends upwardly form the top surface 46 of the base 12 between the first truncated pyramidal wall 48 and the second truncated pyramidal wall 52. The upper ends of the walls 48 and 52 and the panel 56 define the top surface 16. The tapering and angled relationship of the walls 48 and 52 provides superior load-resistive characteristics to that of the prior art of FIG. 1. The load-bearing superiority is achieved by virtue of the H-shaped cross-section of the support structure 14 of the present invention as compared to the T-shaped cross-section of the prior art of FIG. 1. The wide area of the base in combination with the inwardly angled walls 48 and 52 keeps the bar support 10 from being easily tipped over.

Figure 3:
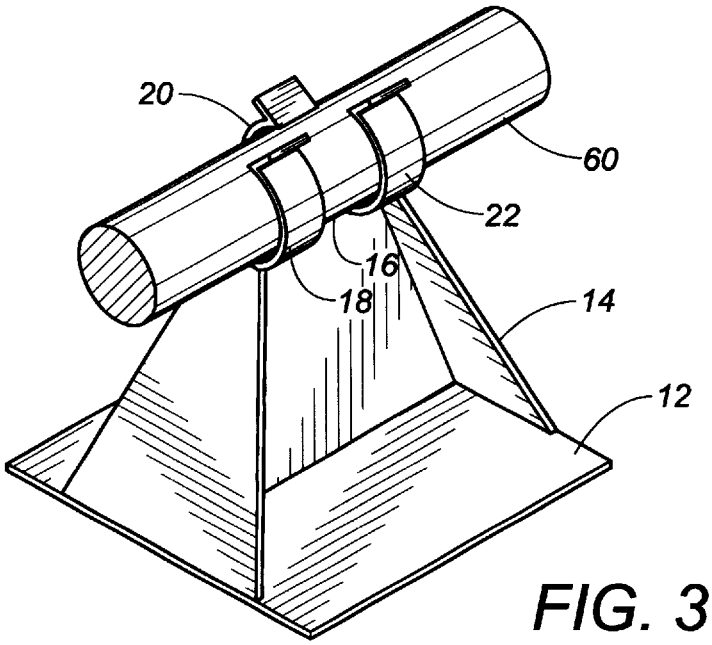
FIG. 3 is a perspective view of the simplified form of the present invention when receiving a rebar therein.

In FIG. 3, it can be seen that the reinforcing bar 60 is positioned into the interior areas between the first clamping member 18, the second clamping member 20 and the third clamping member 22. The reinforcing bar 60 will reside on the top surface 16 of the support structure 14. The base 12 will support the reinforcing bar 60 at a desired distance above the underlined surface.

As can be seen in FIG. 3, the reinforcing bar 60 has a diameter which is greater than the distance between the detent 38 and the second clamping member 20 and the detents 30 and 34 of the respective clamping members 18 and 22. As such, the resilient clamping members 18, 20 and 22 will compressively contact and retain the reinforcing bar 60 therebetween.

Figure 4:
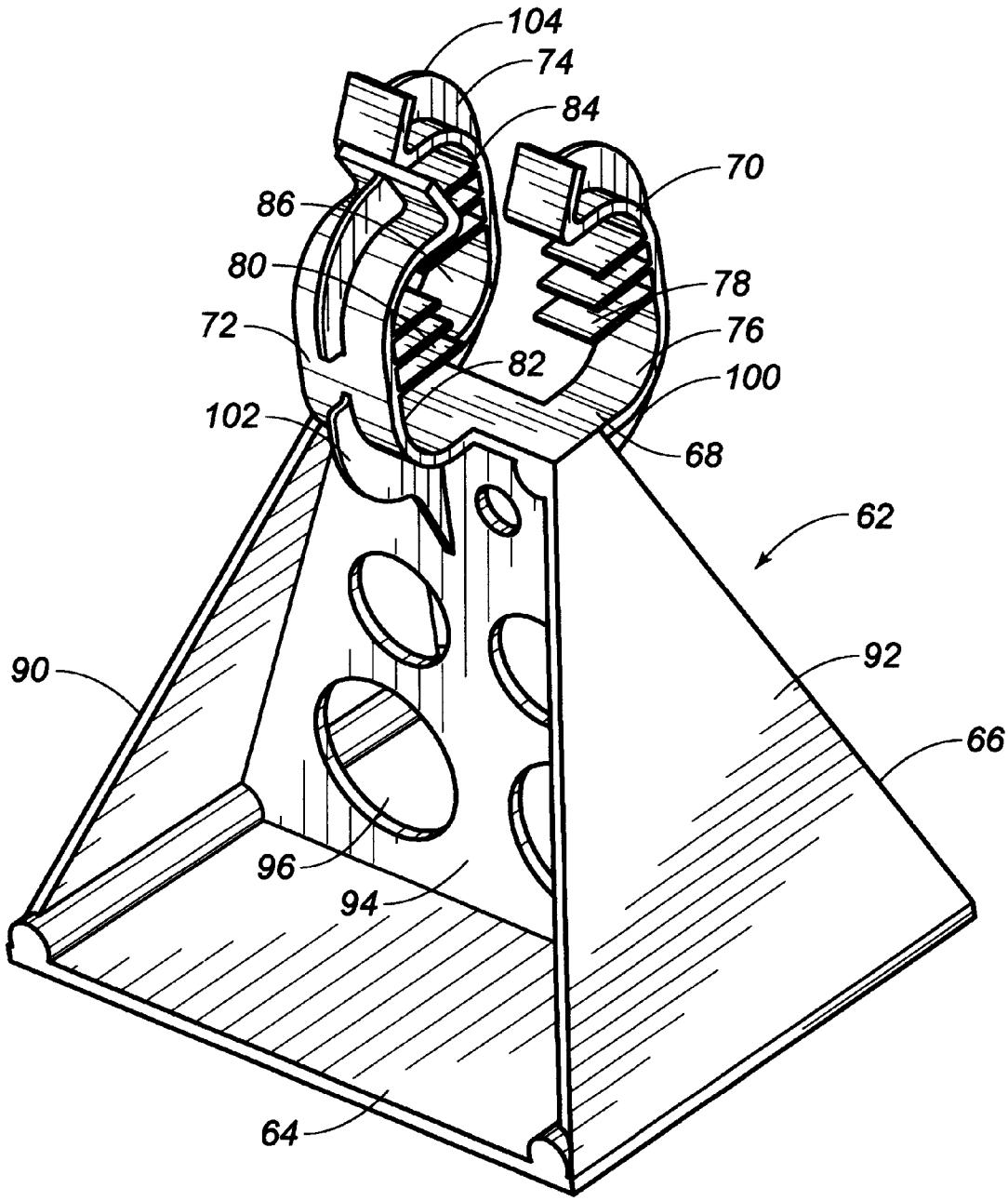
FIG. 4 is an upper perspective view of a preferred embodiment of the bar support in accordance with the teachings of the present invention.

FIG. 4 shows the preferred embodiment 62 of the present invention. The preferred embodiment 62 has a similar configuration of the simplified embodiment 10. In particular, the bar support 62 includes a base 64, a support structure 66, a top surface 68, a first clamping member 70, a second clamping member 72 and a third clamping member 74. The second clamping member 72 will face the first clamping member 70 and the third clamping member 74.

As can be seen in FIG. 4, the first clamping member 70 has an interior surface 76 with a plurality of ribs 78 extending inwardly therefrom. Each of the ribs 78 extends in a horizontal plane and is generally in parallel relationship to each other. The second clamping member 72 also has a plurality of ribs 80 extending inwardly from the interior surface 82. The third clamping member 74 also has a plurality of ribs 84 extending inwardly from the interior surface 86. The ribs 78, 80 and 84 are particularly configured within the concept of the present invention to retain various diameters of rebars therein.

In FIG. 4, it can be seen that the top surface 68 is a generally flat planar surface positioned on the top of the support structure 66. The support structure 66 includes a first truncated pyramidal wall 90 extending upwardly from one side of the base 64, truncated pyramidal wall 92 extending upwardly from an opposite side of the base 64 and a central panel 94 extending upwardly from the top surface of the base 64 between the walls 90 and 92. The panel 94 has a plurality of holes 96 formed therein for the purpose of weight reduction and also for the purpose of allowing concrete flow therethrough. The panel 94, within the concept of the present invention, will not present a barrier to full concrete flow within the structure and will allow the concrete to flow freely therethrough.

Each of the clamping members 70, 72 and 74 has an exterior support rib 100, 102 and 104, respectively. These exterior support ribs 100, 102 and 104 add structural integrity to the respective clamping members 70, 72 and 74. Each of the clamping members 70, 72 and 74 includes a detent of a similar form to that shown in connection with the previous embodiment of the present invention.

Figure 5:
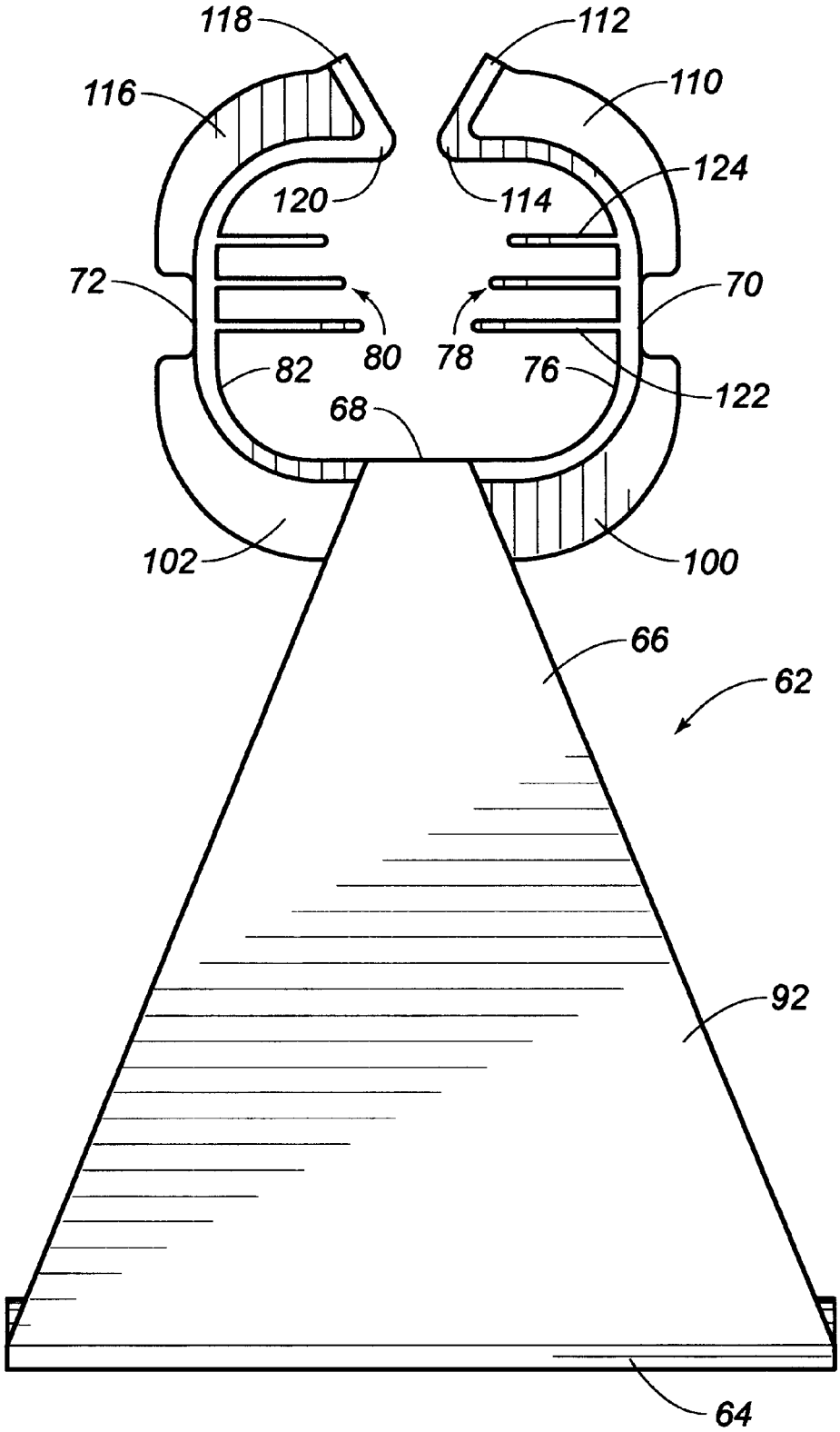
FIG. 5 is an end view of the preferred embodiment of the bar support of the present invention.

In FIG. 5, an end view of the bar support 62 is particularly illustrated. In FIG. 5, the configuration of the first clamping member 70 and the second clamping member 72 is particularly illustrated. The bar support 62 includes the base 64 with the truncated pyramidal wall 92 extending upwardly therefrom. The top surface 68 is defined by the top of the support structure 66.

The first clamping member 70 extends outwardly from the top surface 68 in a generally curved configuration. Supporting rib 100 wraps around the exterior of the lower portion of the clamping member 70 so as to provide structural support therefore. Another exterior support rib 110 is formed along the upper exterior of the clamping member 70 so as to provide support to the upper portion of the clamping member 70 and to the outwardly angled surface 112 extending from detent 114. The second clamping member also has a support rib 102 extending along an exterior surface thereof. Another support rib 116 is formed on the upper exterior surface of the second clamping member 72 adjacent to the upwardly and outwardly angled surface 118 extending from detent 120.

A plurality of ribs 78 extend inwardly from the interior surface 76 of the first clamping member 70. Another plurality of ribs 80 extends inwardly from the interior surface 82 of the second clamping member 72. As can be seen in FIG. 5, the lowermost rib 122 extends inwardly for a greater distance from the interior surface 76 than does the uppermost rib 124. Any intermediate ribs will have inwardly extending length between that of the lowermost rib 122 and the uppermost rib 124. The ribs 80 have a similar configuration.

In normal practice, the reinforcing bar will be placed between the upwardly and outwardly angled surfaces 112 and 118 so as to deform the clamping members 70 and 72 outwardly and to enter the area above the top surface 68 and between the inner surfaces 76 and 82 of respective clamping members 70 and 72. If the rebar has a large diameter, then the ribs 78 and 80 will simply and easily push downwardly in generally compressive contact with the exterior surface of the reinforcing bar. On the other hand, if the reinforcing bar is of a relatively small diameter, it will push through the ribs 78 and 80 so as to be retained below the ribs against the top surface 68. The uppermost ribs will go into generally locking engagement against the exterior surface of the reinforcing bar. As a result, the rebar will not deflect outwardly of the clamping members.

Figure 6:
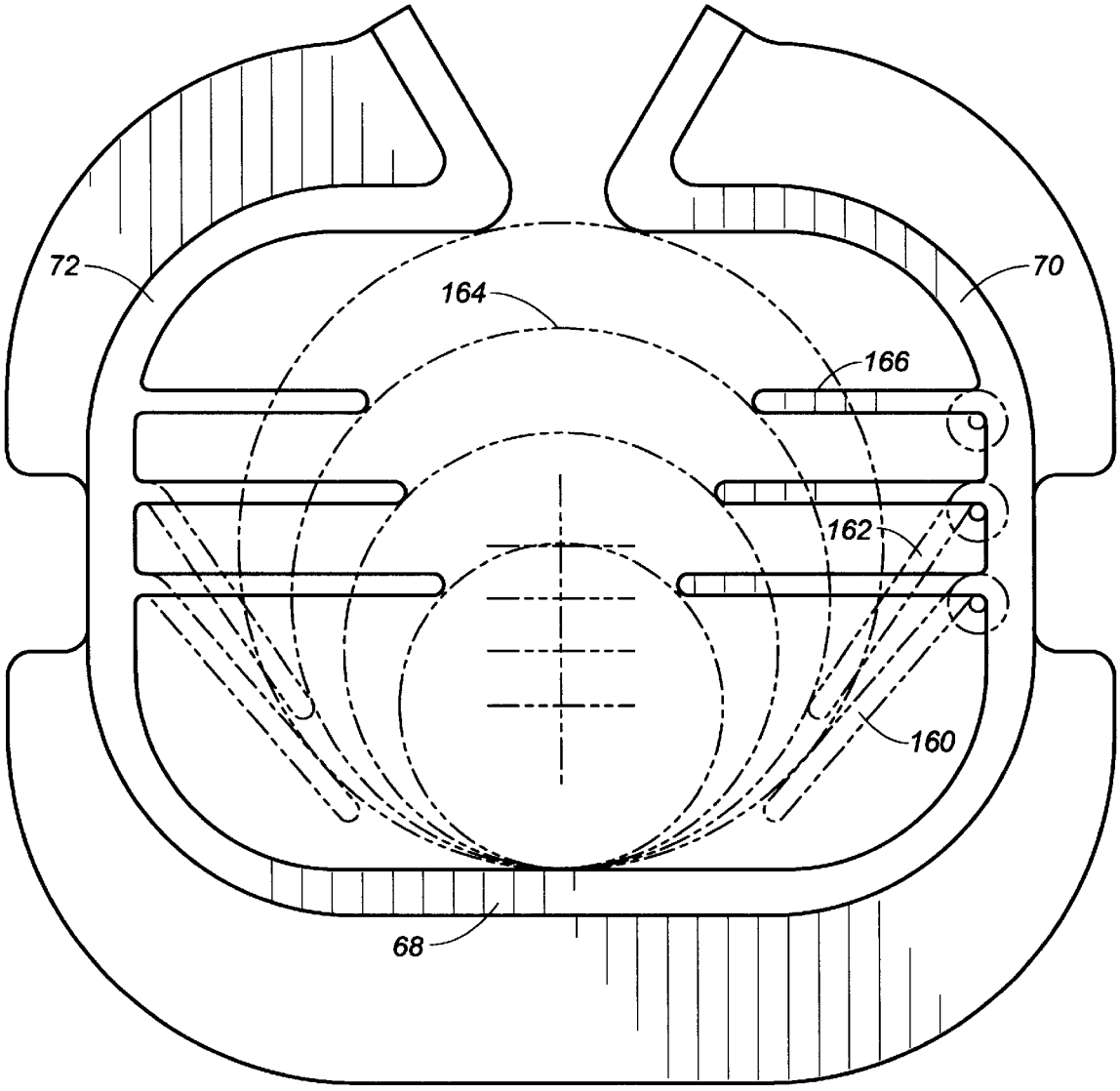
FIG. 6 is a diagrammatic illustration of the manner of receiving rebars of different diameters within the interior surfaces of the clamping members of the bar support of the preferred embodiment of the present invention.

FIG. 6 illustrates, diagrammatically, how the various diameters of rebar can be secured within the interior area between the clamping members 70 and 72. Ribs 160 and 162 of the first clamping member 70 are urged downwardly and inwardly by the outer diameter of rebar 164. However, the uppermost rib 166 will slightly contact the upper exterior surface of the reinforcing bar 164. The ribs associated with the second clamping member 72 will behave in a similar manner. The arrangement of the respective ribs 78 and 80 will create a "centering effect" causing the rebar to reside properly upon the top surface 68. The use of the ribs prevents a misalignment of the bar support relative to the longitudinal axis of the reinforcing bar.

Since the bar support of the present invention is integrally formed of a polymeric material, the bar support can be mass produced in a generally inexpensive manner by injection molding processes.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A concrete reinforcing bar support comprising:

a base;

a support structure extending upwardly from said base, said support structure having a top surface;

a first clamping member affixed to said support structure and extending upwardly above said top surface, said first clamping member having an interior surface; and a second clamping member affixed to said support structure and extending upwardly above said top surface, said second clamping member having an interior surface generally facing and offset from said interior surface of said first clamping member, said interior surface of said first and second clamping members defining a space suitable for receiving a reinforcing bar therebetween, said base and said support structure and said first and second clamping members being integrally formed together of a polymeric material, each of said first and second clamping members having an inwardly extending upper portion extending in generally parallel relationship to said top surface of said support structure, each of said first and second clamping members having a plurality of ribs extending inwardly from said interior surface in an area between the inwardly extending upper portion and said top surface of said support structure, a lower rib of said plurality of ribs extending inwardly from said interior surface a greater distance into said space than a distance that an upper rib of said plurality of ribs extends from said interior surface into said space, said inwardly extending upper portion extending inwardly from said interior surface for a distance greater than the distance that said upper rib extends into said space.

2. The bar support of claim 1, further comprising:

a third clamping member affixed to said support structure and extending upwardly above said top surface, said third clamping member having an interior surface generally facing said interior surface of said second clamping member, said third clamping member being separated by a space from said first clamping member, said third clamping member having a plurality of ribs extending inwardly from said interior surface, said third clamping member having an inwardly extending upper portion extending in generally parallel relationship to said top surface of said support structure.

3. The bar support of claim 2, said second clamping member positioned in a plane of said space between said first and third clamping members.

4. The bar support of claim 3, each of said first clamping member, said second clamping member and said third clamping member having a detent formed on the upper portion thereof, said detent having an angled surface extending upwardly and outwardly from the upper portion.

5. The bar support of claim 1, each of said plurality of ribs being parallel to and spaced from an adjacent rib.

6. The bar support of claim 1, each of said plurality of ribs being flexible.

7. The bar support of claim 1, each of said plurality of ribs extending in a horizontal plane.

8. The bar support of claim 1, said first and second clamping members having an identical configuration facing in opposite directions.

9. A concrete reinforcing bar support comprising:

a flat planar base of a generally rectangular configuration;

a support structure extending upwardly from said base, said support structure having a top surface, said support structure comprising:

a first truncated pyramidal wall extending upwardly and inwardly from one edge of said base;

a second truncated pyramidal wall extending upwardly and inwardly from an opposite edge of said base; and a panel extending vertically upwardly from said base transversely between said first and second truncated pyramidal walls;

a first clamping member affixed to said support structure and extending upwardly above said top surface, said first clamping member having an interior surface; and a second clamping member affixed to said support structure and extending upwardly above said top surface, said second clamping member having an interior surface generally facing and offset from said interior surface of said first clamping member, said interior surface of said first and second clamping members being suitable for receiving a reinforcing bar therebetween, said base and said support structure and said first and second clamping members being integrally formed together of a polymeric material, each of said first and second clamping members having an inwardly extending upper portion extending in generally parallel relationship to said top surface of said support structure, each of said first and second clamping members having a plurality of ribs extending inwardly from said interior surface, in an area between said top surface and the inwardly extending portion Wherein said plurality of ribs each extend inwardly into said interior space different distances.

10. The bar support of claim 9, said panel having a plurality of holes formed therein so as to allow a free flow of concrete therethrough.

11. An apparatus comprising:

a reinforcing bar having a length dimension and a diameter dimension;

a flat planar base;

a support structure extending upwardly from said base, said support structure comprising:

a first truncated pyramidal wall extending upwardly and inwardly from one side of said base;

a second truncated pyramidal wall extending upwardly and inwardly from another side of said base; and a panel extending vertically upwardly from said base between said first and second truncated pyramidal walls;

a first clamping member affixed to said support structure and extending upwardly above a top surface of said support structure, said first clamping member having an interior surface;

a second clamping member affixed to said support structure and extending upwardly above said top surface, said second clamping member having an interior surface generally facing said interior surface of said first clamping member; and a third clamping member affixed to said support structure and extending upwardly above said top surface, said third clamping member having an interior surface generally facing said interior surface of said second clamping member, said second clamping member positioned between said first clamping member and said third clamping member along said length dimension of said reinforcing bar, said first and third clamping members resiliently compressively contacting one side of said reinforcing bar, said second clamping member resiliently compressively contacting another side of said reinforcing bar such that said reinforcing bar resides against said top surface of said support structure, each of said first clamping member and said second clamping member and said third clamping member having an inwardly extending upper portion and a plurality of ribs extending inwardly from the interior surface thereof in an area between said inwardly extending upper portion and said top surface of said support structure, said plurality of ribs extending in parallel spaced relation to each other and extending in planes parallel to said flat planar base.

12. The apparatus of claim 11, said second clamping member having an identical configuration to each of said first and third clamping members, said second clamping member facing in a direction opposite to that of said first and third clamping members.

13. The apparatus of claim 11, said support structure having a generally H-shaped cross-section in a plane parallel to said base.

14. The apparatus of claim 11, said panel having a plurality of holes formed therein so as to allow a free flow of concrete therethrough.

15. The apparatus of claim 11, each of said plurality of ribs contacting an exterior surface of said reinforcing bar.

16. The apparatus of claim 15, a lower rib of said plurality of ribs extending inwardly of said interior surface into a space between the clamping members a greater distance than an upper rib of said plurality of ribs extends inwardly into the space from said interior surface, each of said plurality of ribs being flexible.

17. The apparatus of claim 11, said base and said support structure and said clamping members being integrally formed together of a polymeric material.

* * * * *